United States Patent [19]

Barry

[11] Patent Number: 4,513,553

[45] Date of Patent: Apr. 30, 1985

[54] HOLLOW CORE DOOR AND METHOD FOR MAKING

[76] Inventor: David J. Barry, 1739 W. Nancy Creek Dr., N.E., Atlanta, Ga. 30319

[21] Appl. No.: 512,460

[22] Filed: Jul. 11, 1983

[51] Int. Cl.[3] ..... E06B 3/70

[52] U.S. Cl. ..... 52/456; 52/741

[58] Field of Search ..... 52/455–458, 52/476, 824, 741

[56] References Cited

U.S. PATENT DOCUMENTS

| | | | |
|---|---|---|---|
| 579,696 | 3/1897 | Carter | 52/455 |
| 632,700 | 9/1899 | Cronin | 52/456 |
| 682,322 | 9/1901 | Cronin | 52/455 |
| 3,305,992 | 2/1967 | Steed | 52/455 |
| 4,441,296 | 4/1984 | Grabendike et al. | 52/456 |

*Primary Examiner*—James L. Ridgill, Jr.
*Attorney, Agent, or Firm*—James B. Middleton

[57] ABSTRACT

A method for manufacturing a hollow core panel door, and the door made by the method. The method includes the providing of a single form of molding for holding panel inserts, the molding being useable as both rails and stiles. Door facings are cut out for panels, top and bottom rails are placed between the facings, and top and bottom rails, made of the molding, are provided for each panel. Panel inserts are made by providing a rectangular frame, placing facings on each side of the frame, then shaping the edges to make a panel insert. Panel inserts are slid into top and bottom rails. The panel inserts are held in place by core stiles, also formed of the single form of molding, and outside stiles close the edges of the door. The core stiles are notched to receive the top and bottom rails; and, if the door includes a mullion, mullion stiles of the same molding will also be notched to receive the top and bottom rails.

8 Claims, 6 Drawing Figures

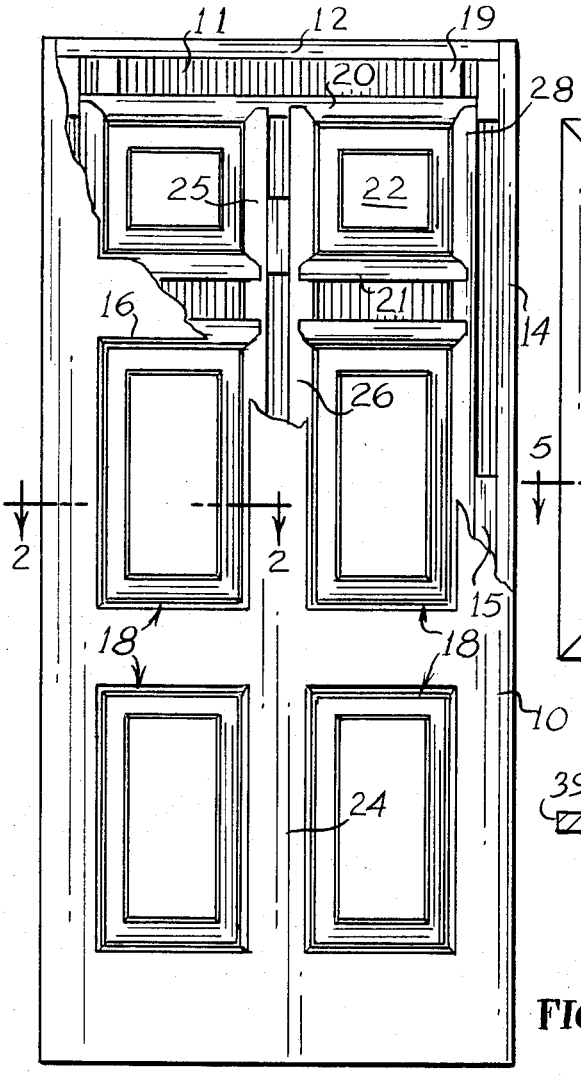
FIG. 1
FIG. 3
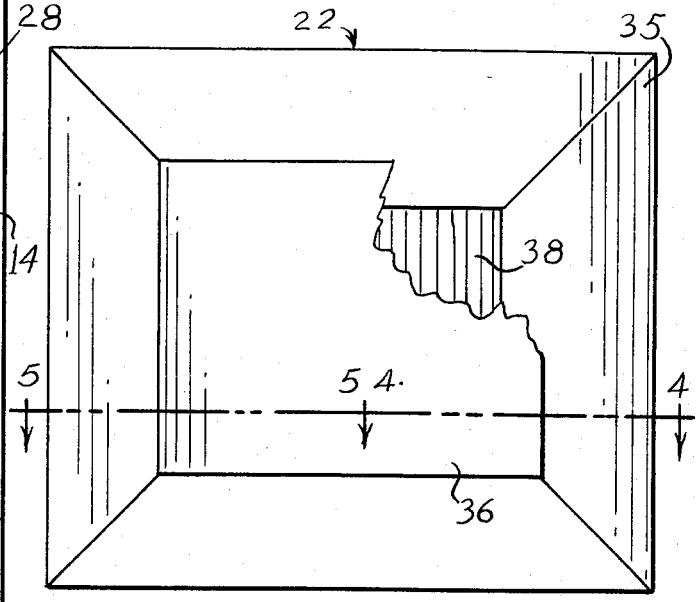
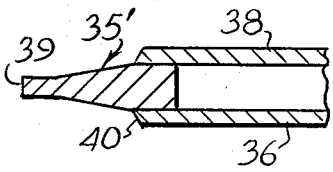
FIG. 5
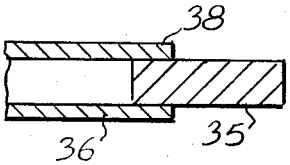
FIG. 4
FIG. 2
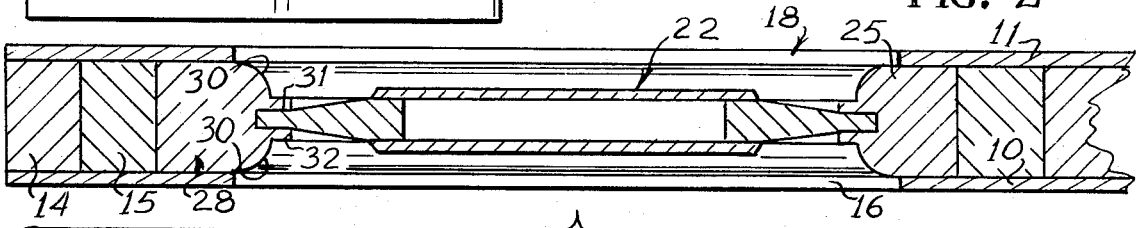
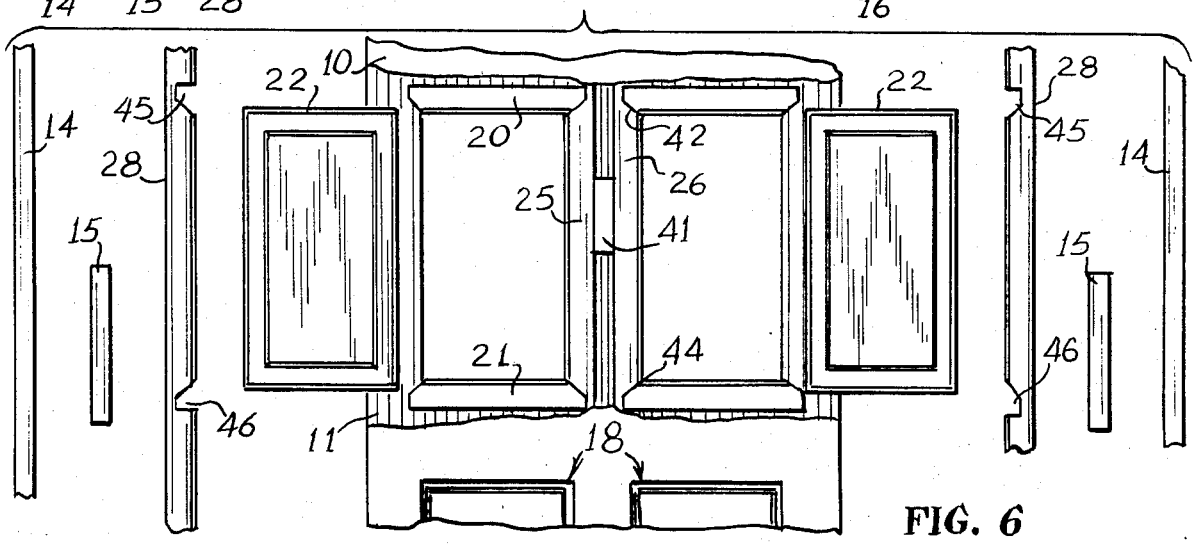
FIG. 6

HOLLOW CORE DOOR AND METHOD FOR MAKING

INFORMATION DISCLOSURE STATEMENT

Doors having a plurality of panels therein have been long favored for their aesthetic qualities. Difficulties with panel doors have included the weight of the door, since panel doors have usually been made of solid wood, and the attendant expense. Another problem that tends to be a natural result of the fact that the panel doors are made of solid wood is that the doors tend to warp. It is well known that a piece of wood will tend to warp as the wood becomes completely dried, resulting in a door that no longer properly fits the opening. While there have been numerous efforts to prevent the warping of doors, the only readily acceptable solution is the use of extremely well dried wood in an effort to prevent the warping as the wood dried. Hollow core doors have been used for many years, but these doors comprise a wood frame with flat panels of thin wood, press-board or the like, so the hollow core door is generally unadorned. Some efforts have been made to apply molding to a conventional hollow core door to give the illusion of a panel door, but the aesthetic result is not the same and there continues to be a market for the true panel door. There has been some effort at creating a hollow panel door, but such doors have not met with commercial success. The doors have had hollow rails and/or stiles, but the panels have usually been thin, flat wood or other material, and construction of the doors has been very time consuming.

SUMMARY OF THE INVENTION

This invention relates generally to panel doors, and is more particularly concerned with a hollow core panel door and a method for constructing the same.

The present invention provides a hollow core door having upper and lower rails and outside stiles sandwiched by facings; and, within the confines of the top and bottom rails and the two outside stiles, there is a panel assembly comprising a plurality of parallel moldings for receiving panels therebetween. Though the door made in accordance with the present invention may take many forms, the construction is such that a single form of molding can be utilized throughout the panel assembly. The arrangement is such that the panel receiving moldings are put into place between the door facings and between the top and bottom rails, the panels are slipped into the panel receiving moldings, and appropriate spacers and outside stiles are applied to complete the door. The door facings are pre-cut with appropriate openings for exposing the panels.

BRIEF DESCRIPTION OF THE DRAWINGS

These and other features and advantages of the present invention will become apparent from consideration of the following specification when taken in conjunction with the accompanying drawings in which:

FIG. 1 is a front elevational view of a door made in accordance with the present invention, a portion of one door facing being broken away to show the internal construction of the door;

FIG. 2 is an enlarged cross-sectional view taken substantially along the line 2—2 in FIG. 1;

FIG. 3 is an enlarged, front elevational view of one panel insert for use in the door shown in FIG. 1, a portion thereof being broken away to show the construction;

FIG. 4 is a cross-sectional view taken substantially along the line 4—4 in FIG. 3, and showing the panel insert as originally constructed;

FIG. 5 is a cross-sectional view taken substantially along the line 5—5 in FIG. 3 and showing the panel insert after shaping; and, FIG. 6 is a partial front elevational view of the door as shown in FIG. 1, portions being shown exploded therefrom to illustrate the construction.

DETAILED DESCRIPTION OF THE EMBODIMENT

Referring now more particularly to the drawings, and to that embodiment of the invention here presented by way of illustration, the door shown in FIG. 1 is a six-panel door, this particular door being for purposes of illustration only, and it will be readily apparent to those skilled in the art that the same construction, and method of construction, can be utilized for virtually any panel door, with or without the central mullion. In FIG. 1, it will be seen that the door appears as a generally conventional panel door, except where the facing is broken away to show the construction. Thus, the door includes a front facing 10 and a rear facing 11. To form the conventional hollow core door, it will be understood that there are top and bottom rails such as the rail 12, and outside stiles such as the stile 14. Conventionally, the front and rear facings 10 and 11 will complete the hollow core door, though lock blocks such as the block 15 may be included where needed.

It will be seen in FIG. 1 of the drawings that the front facing 10 includes a plurality of panel cut-outs 16 to expose the panel generally designated at 18; and, where the front panel 10 is broken away, the structure to provide the support for the panels is shown.

In general, it will be seen that there are spacer blocks such as the spacers 19, spacing an upper core rail 20 from the upper outside rail 12. Spaced from the core rail 20, and the parallel thereto, are additional core rails 21. As will be discussed in more detail hereinafter, it will be understood that a panel insert 22 is received between the core rails 20 and 21.

Since the door here chosen for illustration includes a mullion generally designated at 24, it will also be understood that there are mullion stiles designated at 25 and 26. The mullion stiles 25 and 26 receive one edge of the panel insert 22; and, a core stile 28 completes the framing around the panel insert 22.

With this general description in mind, attention is next directed to FIG. 2 of the drawings. In looking at FIG. 2, it will be understood that each of the panels 18 will be constructed in a similar manner, so the same reference numerals are used for the same parts regardless of the particular panel being discussed. It will be recognized, as was mentioned above, that the sizes and shapes of the panels and the number of panels per door, can be varied using the same construction and assembly methods.

In FIG. 2 it will be seen that the mullion stile 25 and the core stile 28 are identically shaped in cross-section. The member from which the stiles are constructed includes the generally rectangular base portion with shoulders 30 that are shaped as a quarter of a circle. The central portion of the stile defines a channel 31 having generally parallel, straight lips 32. The panel insert 22 is received within the channel 31, and will be sized to be slideable therein.

It will now be seen that the stile 28 is placed between the door facings 10 and 11, and so aligned with the opening 16 in the facing to create the effect of the conventional shaping of panels in a panel door. It will be seen that the square cut of the opening 16 provides a shoulder leading into the quarter-round portion 30, and terminating in the square shoulder of the lip 32.

The panel insert designated at 22 also has a hollow core. The panel insert 22 is so constructed as to give the appearance of solid construction as is typical in solid panel doors; but, again, the hollow panel insert can be more cheaply constructed and will have less weight.

Looking at FIGS. 3, 4 and 5 it will be seen that the panel insert 22 is constructed utilizing flat pieces of wood having a rectangular cross-section as is shown in FIG. 4, the cross-sectional shape being shown by the vertical member 35. The ends of the members such as the member 35 are mitered, and a rectangular frame is constructed, the outside dimensions of the frame being the desired outside dimensions of the panel insert 22. Panel insert facings such as the facings 36 and 38 are then attached to the frame. Those skilled in the art will understand that this construction is very easy and economical to accomplish, and can be used for virtually any size of panel insert 22.

After the basic construction has been accomplished, the panel insert having the shape as shown in FIG. 4, the edges of the panel insert can be passed through a shaper to achieve the final desired shape. The panel insert as shown in FIG. 5 illustrates the insert after shaping. Here it will be seen that the member 35, now designated at 35', has been provided with an outer edge designated at 39, the edge 39 being of the appropriate thickness to be received within the channel 31. From the edge 39, the member 35' slopes towards the original thickness where the facings 36 and 38 are attached. As shown in FIG. 5, the facings 36 and 38 have also been shaped somewhat to be beveled, as at 40. The shaping therefore gives the panel insert 22 an attractive appearance having the same aesthetic appeal as a conventional, solid, panel door.

From the foregoing description, the method for constructing a door in accordance with the present invention should be understandable. for a further discussion of this method, attention is directed primarily to FIG. 6 of the drawings. In FIG. 6, it will be seen that the central portion of the figure illustrates the center section of a door as is shown in FIG. 1 of the drawings, and the facing 10 is partially broken away to show the structure of the central panels 18 of the panel door. It will therefore be seen that the mullion stiles 25 and 26 are in position, and there is a spacer 41 between the stiles 25 and 26. The stiles 25 and 26 are notched as at 42 and 44 to receive the core rails 20 and 21. It is contemplated that the door would be so designed that the mullion stiles 25 and 26 would be appropriately provided with notches such as the notches 42 and 44, and the stiles 25 and 26 would then be assembled with the rest of the door. Having the notches 42 and 44, the rails 20 and 21 can then be placed into the notches and fixed to the facings 10 and 11.

Following the above construction, it will be seen that the panel inserts 22 can be slid from the outside edges of the door to be received within the core rails 20 and 21, the upper and lower edges of the panel inserts 22 being received within the channels 31 of the rails. The panel insert 22 would be slid along the rails 20 and 21 until the inner edges 39 of the panel inserts 22 engage the channel 31 in the mullion sitles 25 and 26.

After the panel inserts 22 are in place, the core stiles 28 can be put into place. It will be noted that the core stiles 28 have the notches 45 and 46 appropriately placed to receive the opposite ends of the rails 20 and 21. Thus, the stiles 28 can simply be put into place to hold the panel inserts 22 in the proper location, the stiles 28 receiving the outer edges of the panel inserts 22 within their channels 31. When the stiles 28 are in position, any spacers required may be put into place, and lock blocks such as the lock blocks 15 can be put into place against the stiles 28. Finally, the outside stiles 14 will be put into place; and, it will be understood that the facings 10 and 11 are properly sized, and the other pieces of the door described above are also appropriately sized so that, when the outside stiles 14 are put into place, there will be a completed door as shown in FIG. 1 of the drawings.

Thus, it will be understood by those skilled in the art that the door facings 10 and 11 can be mass produced, as by die cutting or the like. A single shape of molding can be used for the core stiles and rails, that shape being the one described in detail in conjunction with FIG. 2 of the drawings. This single shape can be cut into appropriate lengths, and appropriately notched to act as all of the core rails such as the rails 20 and 21, and all of the core stiles such as the stiles 25, 26 and 28. The outside rails and stiles are conventional rectangular lumber as is currently used for hollow core doors. The panel inserts are initially formed from conventional rectangular lumber with sheet material used as the facings, then the edges are shaped as desired.

With all pieces manufactured in large quantities, but cut to appropriate lengths and appropriately notched with accuracy, it will be seen that it will be very easy to assembly a panel door. The openings 16 in the facings are pre-cut, and the top and bottom rails 12 can be put into place with the spacers 19; then, the mullion stiles (if required for the particular design) can be put into place along with the core rails 20 and 21. At this point the various panel inserts 22 will be slipped into the channels 31 of the rails 20 and 21. When the panel inserts are in place, the core stiles 28 will be put into place, spacers inserted, and outside stiles 14 complete the door.

It will therefore be seen that the present invention provides a panel door formed as a hollow core door. The construction is such that the door will be exceptionally light weight, but the door has the somewhat massive appearance of a conventional panel door, even the panels being sufficiently massive looking that the door appears to be formed of solid material. The method for constructing the door is very simple since the various pieces will be pre-cut so the door can be finally assembled by relatively unskilled labor.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as defined in the appended claims.

I claim:

1. A hollow core panel door including a front and rear facing defining cut-outs therein and located for defining a plurality of panels, a panel assembly between said facings for supporting said plurality of panels, said panel assembly including a plurality of top core rails located adjacent to the upper edge of said cut-outs, a plurality of bottom core rails located adjacent to the lower edge of said cut-outs, and a plurality of panel inserts, said top core rails and said bottom core rails defining grooves therein for slidably receiving said panel inserts, said panel assembly further including a first core stile defining a groove therein, said first core stile being located to receive one edge of said plurality of panels, a second core stile parallel to said first core stile and defining a groove receiving another edge of said plurality of panels, said first core stile and said second core stile defining notches therein for receiving the opposite ends of each of said core rails, said panel door further including outside rails and outside stiles at the edges of said facings.

2. A hollow core panel door as claimed in claim 1, each panel insert of said plurality of panel inserts comprising a frame, and insert facings on each side of said frame.

3. A hollow core panel door as claimed in claim 2, the outer edges of said frame being of such thickness as to be slidably received in said grooves.

4. A method for constructing a hollow core panel door having an integral front facing and an integral rear facing, and defining a plurality of panels therein so that said hollow core panel door simulates a solid panel door, said method including the steps of providing cut-outs in said front and rear facings for defining the size and location of said panels, juxtaposing said facings with top and bottom rails therebetween at the top and bottom edges of said facings, placing top core rails and bottom core rails between said facings at the top and bottom of said cut-outs for each of said panels, said top and bottom core rails defining grooves therein, sliding panel inserts into said grooves in said top and bottom core rails until said panel inserts are aligned with said cut-outs in said front and rear facings, securing said panel inserts with core stiles, said core stiles having grooves therein for receiving the edge of said panel inserts, and placing outside stiles between said facings at the edges thereof.

5. A method as claimed in claim 4, said method further including the steps of providing a single molding shape of indeterminate length defining said groove therein, and using portions of said indeterminate length for said top and bottom core rails for each of said panels, and using other portions of said indeterminate length for said core stiles.

6. A method as claimed in claim 5, and further including the step of providing notches in said core stiles, said notches being located for receiving said top and bottom core rails for each of said panels.

7. A method as claimed in claim 6, said door including a mullion with some of said plurality of panels on each side of said mullion, said method including the steps of using portions of said indeterminate length for providing parallel mullion stiles, notching said mullion stiles for receiving said top and bottom core rails for each of said panels, placing spacers between said mullion stiles, and carrying out the step of sliding panel inserts into said grooves in said top and bottom core rails by sliding panels from each side of said door towards said mullion stiles until the edges of the panel inserts are received within the groove in said mullion stiles.

8. A method as claimed in claim 4, and further including the steps of assembling a panel insert frame, placing a panel insert facing on each side of said panel insert frame, and shaping the edges of said panel insert before the step of sliding panel inserts into said grooves.

* * * * *